US005664606A

United States Patent [19]

Anderson

[11] Patent Number: 5,664,606

[45] Date of Patent: Sep. 9, 1997

[54] DRILL PIPE HAVING CONCAVE WRENCHING RECESSES

[75] Inventor: Llewellan Anderson, Renton, Wash.

[73] Assignee: Atlas Copco Robbins Inc., Kent, Wash.

[21] Appl. No.: 477,305

[22] Filed: Jun. 7, 1995

[51] Int. Cl.[6] ..... F16L 9/00

[52] U.S. Cl. ..... 138/109; 138/177; 173/152; 175/320

[58] Field of Search ..... 138/109, 177; 175/320, 325.7, 85, 53; 173/152, 159, 163, 197

[56] References Cited

U.S. PATENT DOCUMENTS

| | | | |
|---|---|---|---|
| 3,754,605 | 8/1973 | Porter et al. . | |
| 3,768,579 | 10/1973 | Klein . | |
| 3,802,057 | 4/1974 | Porter . | |
| 5,447,207 | 9/1995 | Jones | 173/325.7 X |

OTHER PUBLICATIONS

Robbins Company , Drawing for Raise Boring Machine 71RH–1252, 1979.

*Primary Examiner*—Patrick Brinson
*Attorney, Agent, or Firm*—Graybeal Jackson Haley LLP

[57] ABSTRACT

A drill pipe has a central axis and comprises a first end and a second end with a portion of the second end being substantially triangular in the lateral cross-section and having three faces. At least one concave wrench recess is located in each of the three faces of the substantially triangular portion of the second end. Each of the recesses has a surface with an axially extending center line. The center line is located a predetermined distance from the central axis, with this predetermined distance being less than the distance from the central axis of all other axial lines on the surface of the recess.

Each of the recesses may be comprised of two adjoining planes having exterior surfaces, the cross-section of the two adjoining planes forming an angle of less than 180 degrees as measured between the exterior surfaces of the two adjoining planes. Alternatively, the recesses can be comprised of three adjoining planes. Finally, the recesses may be comprised of an arcuate segment.

40 Claims, 4 Drawing Sheets

DRILL PIPE HAVING CONCAVE WRENCHING RECESSES

BACKGROUND

I. Field of the Invention

This invention relates to tunnel or shaft boring sectional drill pipes comprising a plurality of pipe sections joined together by threaded pin and box type tool joints. The subject invention more particularly relates to the wrenching recesses or "flats" on the drill pipe, which are gripped by a mechanical or manual auxiliary apparatus for "makeup" and "breakout" of the drill pipes.

II. Description of the Prior Art

U.S. Pat. No. 3,768,579 issued to Klein discloses a drill pipe breakout mechanism for a drill pipe that is substantially square in lateral cross-section, having four faces. Each of these four faces has a pair of axially spaced recesses thereon. However, this four-sided drill pipe configuration is inefficient in terms of load sharing because, of the four sides, only two of the sides at a time take substantial loads during makeup or breakout. Thus, for higher torque applications, damage to the wrench recesses or flats is more likely because only two groups of these flats, not all four groups, are sharing the applied torque load.

U.S. Pat. No. 3,802,057 issued to Porter discloses an improvement over the four-sided drill pipe configuration. Namely, the drill pipe in Porter has a portion that is substantially triangular in lateral cross-section and has three faces. A pair of wrench recesses are located on each of the three faces, each pair of wrench recesses being axially spaced. As best seen in FIGS. 12 and 13 of Porter, the two axially spaced recesses comprising each flat set in Porter have different configurations. More specifically, as seen in FIG. 12, the top recess has what is known in the art as a "bathtub" configuration. This configuration is defined as having two adjoining planes which form an angle of greater than 180 degrees (i.e., a reflex angle) as measured from the exterior surfaces of the two adjoining planes. The Porter bathtub configuration has major disadvantages. The bathtub configuration was first implemented to facilitate wrenching in the drive head with an automatic or remote control wrenching arrangement. The bathtub recesses are substantially elongated, such that tangential jaws of the automatic wrenching device can mate therein and allow the drive box to float over the fixed tangential jaws in the drive head. The above configuration leads to a substantially elongated arrangement which protrudes markedly above the work table. This high protrusion is undesirable for machines that are required to be of low profile for underground operation. Furthermore, this bathtub configuration produces an inherent weakness in the drill pipe where the pipe cracks between the pin shoulder of the connection and the innermost machine surface of the bathtub, which is, of course, greatly detrimental to the strength and life of the drill pipe.

FIG. 13 of Porter shows the bottom flat, which is not a recess at all, but is merely a planar portion present on each of the three sides of the triangular drill pipe. The traditional three-sided flat configuration of FIG. 13 is undesirable in that the radial forces associated with this configuration are very high, thus resulting in a very large minimum wrench load being necessary to facilitate makeup and breakout. The higher the minimum wrench load, the more likely that the flats of the drill pipe will be damaged during makeup or breakout.

A need thus exists for a drill pipe having wrenching recesses wherein the wrenching recesses evenly share the applied load.

A need also exists for a drill pipe having wrenching recesses wherein low radial loads are required to facilitate makeup and breakout.

A need further exists for a drill pipe having wrenching recesses which are easy to machine.

An additional need exists for a drill pipe having wrenching. recesses which do not induce cracking of the drill pipe.

Finally, a need exists for a drill pipe having wrenching recesses wherein the portion of the drill pipe having the wrenching recesses and the machine employed to makeup and breakout the drill pipe both have a low profile for use in underground environments.

SUMMARY OF THE INVENTION

A drill pipe has a central axis and comprises a first end and a second end with a portion of the second end being substantially triangular in the lateral cross-section and having three faces. At least one concave wrench recess is located in each of the three faces of the substantially triangular portion of the second end. Each of the recesses has a surface with an axially extending center line. The center line is located a predetermined distance from the central axis, with this predetermined distance being less than the distance from the central axis of all other axial lines on the surface of the recess.

Each of the recesses may be comprised of two adjoining planes having exterior surfaces, the cross-section of the two adjoining planes forming an angle of less than 180 degrees as measured from the exterior surfaces of the two adjoining planes. Alternatively, the recesses can be comprised of three adjoining planes. Finally, the recesses may be comprised of an arcuate segment.

Most preferably, the second end of the drill pipe has a second portion which is also substantially triangular in lateral cross-section and has three faces. The second portion is axially spaced from the first portion of the second end of the drill pipe, and at least one concave wrench recess is present in each of the three faces of this second portion. Each of these recesses also preferably has a surface with an axially extending center line. This center line is located a predetermined distance from the central axis of the drill pipe that is less than the distance from the central axis of all other axial lines on the surface of the recess.

The first end of the drill pipe also preferably has a portion which is substantially triangular in lateral cross-section and has three faces, with at least one concave wrench recess located in each of the three faces. The first end of the drill pipe may also have a second portion which is substantially triangular in lateral cross-section and which has three faces, with at least one concave wrench recess in each of the three faces of the second portion. This second portion is axially spaced from the first portion of the first end of the drill pipe. The recesses on the two portions of the first end of the drill pipe preferably each have a surface with an axially extending center line. The center line is located a predetermined distance from the central axis of the drill pipe. This predetermined distance is less than the distance from the central axis of all other axial lines on the surface of the recess.

BRIEF DESCRIPTION OF THE DRAWINGS

A more complete appreciation of the invention may be had by reference to the accompanying drawings illustrating preferred embodiments of the invention to be described in detail, wherein.

DETAILED DESCRIPTION OF THE PREFERRED EMBODIMENTS

Figure 1:
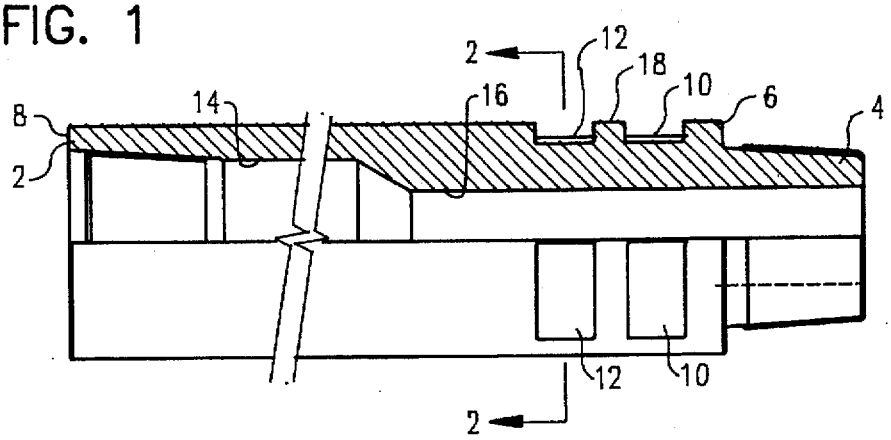
FIG. 1 is a view partially in elevation and partially in longitudinal section of a length of drill pipe of the present invention.

First referring to FIG. 1, the box end and pin end of the drill pipe of the present invention are shown in detail. Drill pipe 1 includes box end 2 and pin end 4. Pin end 4 includes pin shoulder 6, and box end 2 includes box shoulder 8. Box end 2 has female threads and pin end 4 has male threads, such that drill pipe 1 is matable with other drill pipe segments such that box shoulder 8 of drill pipe 1 will abut the pin shoulder of one piece of additional drill pipe, and pin shoulder 6 of drill pipe 1 will abut the box shoulder of another piece of additional drill pipe. To makeup or breakout drill pipe 1 with other drill pipe segments, torque must be applied to drill pipe 1. Upper set of concave wrench recesses 10 and lower set of concave wrench recesses 12 facilitate the aforesaid makeup and breakout. More specifically, upper set of concave wrench recesses 10 are primarily used for applying the torque in either makeup or breakout, and are configured to be used with a wrap-around wrench in the head frame or an automatic wrenching arrangement, both discussed in detail below. Lower set of concave wrench recesses 12 are employed primarily to support the mass of the drill pipe 1 in a work table.

Box end 2 has a portion 14 with a larger diameter bore in order to reduce the weight of drill pipe 1 while maintaining adequate strength therein for the torque and tension applied to drill pipe 1. Pin end 1 has a portion 16 where the bore of drill pipe 1 has a decreased diameter due to the need for greater torque and tension strength at pin end 4. Note that larger diameter portion 16 continues past lower set of concave wrench recesses 12 such that drill pipe 1 has sufficient strength for the addition of a third set of concave wrench recesses (not shown) below lower set of concave wrench recesses 12 if the threads on pin end 4 become damaged. In this case, upper set of concave wrench recesses 10 would be removed by machining and replaced with new thread, the lower set of concave wrench recesses 12 would then become the upper set of concave wrench recesses, and the additional third set of concave wrench recesses would be the new lower set of concave wrench recesses.

Between the pin end 4 and upper set of concave wrench recesses 10 is pin shoulder 6, previously mentioned. Between upper set of concave wrench recesses 10 and lower set of concave wrench recesses 12 is second shoulder 18, whose function is to enable the weight of a drill pipe segment attached to drill pipe 1 to be supported.

Figure 2:
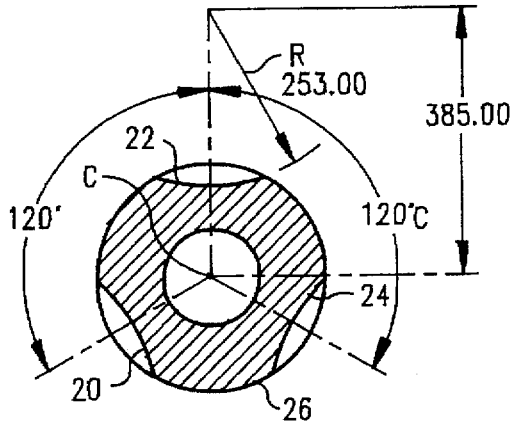
FIG. 2 is a lateral cross-sectional view of the drill pipe of FIG. 1 taken at lines 2—2.

Referring to FIG. 2, a lateral cross-section of the drill pipe 1 is shown. More specially, three concave wrench recesses 20, 22 and 24 are shown. Concave wrench recesses 20, 22 and 24 can form either upper set of concave wrench recesses 10 or lower set of concave wrench recesses 12. To ensure symmetry, concave wrench recesses 20, 22 and 24 are radially spaced at 120-degree increments around drill pipe 1. Concave wrench recesses 20, 22 and 24 are shown in FIG. 2 to be arcuate segments, but, as described in greater detail herein, it is readily apparent that concave wrench recesses can be of other configurations besides arcuate. For example, concave wrench recesses 20, 22 and 24 can be formed of either two or three adjoining planes. When concave wrench recesses 20, 22 and 24 are arcuate segments, these arcuate segments may, for example, be defined by the following dimensions. For example, in a 12 ⅞ inch diameter (one of industry standards) drill pipe 1, the arcuate segment of concave wrench recesses 20, 22 and 24 may be arcuate segments of circles having centers located 385 millimeters from the center C of drill pipe 1 when said circles have radii R of 250 millimeters. It is to be noted that the above dimensions are only exemplary and it is readily apparent to one skilled in the art that arcuate segments of other dimensions can be employed to form concave wrench recesses 20, 22 and 24. The considerations that determine the configuration of concave wrench recesses 20, 22 and 24 in FIG. 2, as well as those of FIGS. 6E through 6G, include the maximization of the strength of drill pipe 1 in regard to section modulus and moment of inertia, as well as ensuring that adequate surface area is present to withstand the maximum dead weight supported by box end 2 and/or pin end 4.

Figure 3:
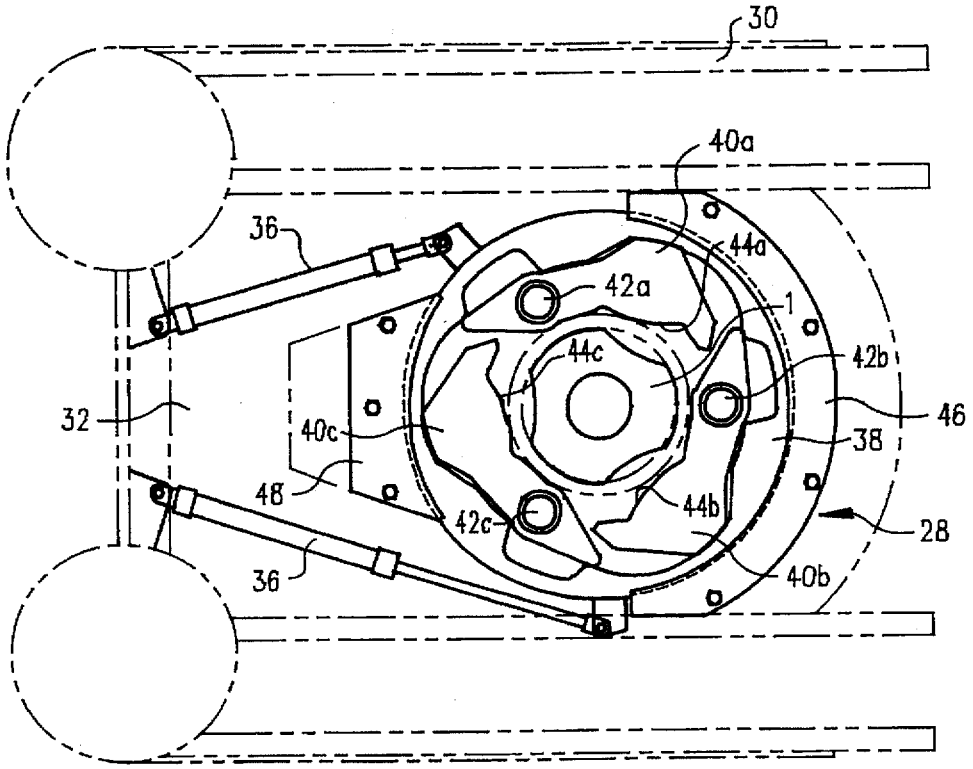
FIG. 3 is a top view of an automatic wrenching device for makeup and breakout of the drill pipe of the present invention, showing the device prior to gripping the drill pipe of the present invention.
Figure 4:
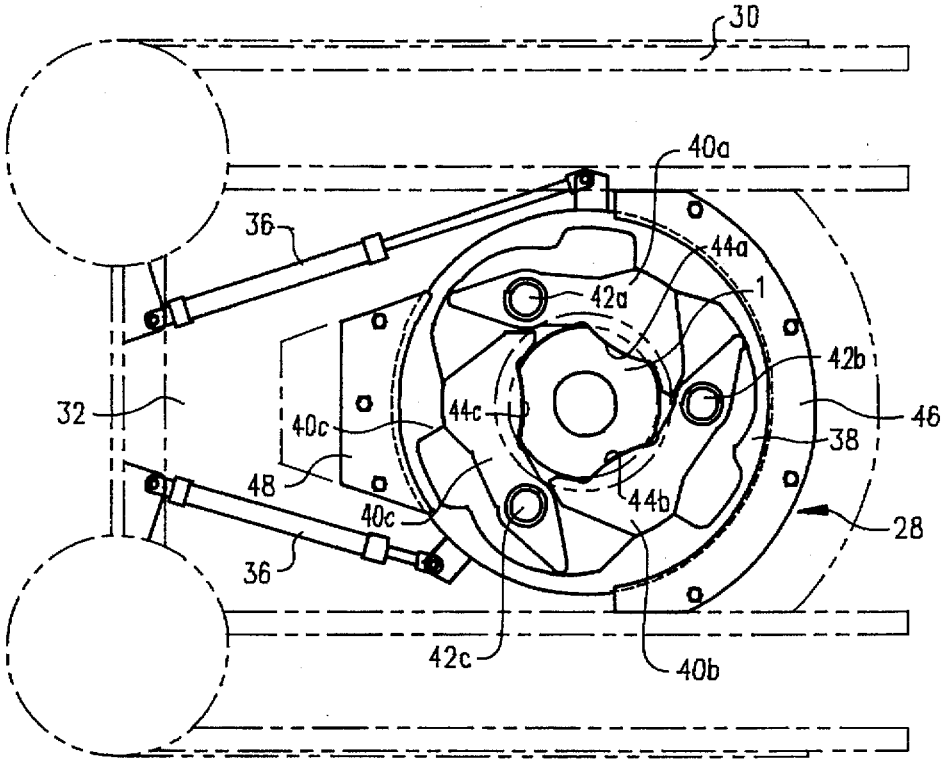
FIG. 4 is a top view of an automatic wrenching device for makeup and breakout of the drill pipe of the present invention, showing the device gripping the drill pipe of the present invention.

In FIGS. 3 and 4, automatic wrenching device 28 is shown. Automatic wrenching device 28 is specifically designed to function with drill pipe 1 of the present invention having concave wrench recesses. A general disclosure of automatic wrenching devices is given in U.S. Pat. No. 3,802,057 issued to Porter, which is incorporated herein by reference. As shown in FIG. 3, which shows automatic wrenching device 28 in a configuration in which drill pipe 1 is not being gripped, and FIG. 4 which shows automatic wrenching device 28 gripping drill pipe 1, automatic wrenching device 28 is located in main frame 30 and is supported on work table 32. Automatic wrenching device 28 includes cylinders 36 which connect work table 32 and cam ring 38. Cylinders 36 are pivotally connected to cam ring 38 such that, as one of cylinders 36 is energized while the other is de-energized, cam ring 38 rotates either clockwise or counterclockwise. Cam ring 38 is connected to jaws 40*a*, 40*b* and 40*c* by means of pins 42*a*, 42*b* and 42*c* around which jaws 40*a*, 40*b* and 40*c*, respectively, pivot as cam ring 38 rotates between a clockwise and counterclockwise position. More specifically, as cam ring 38 rotates in a clockwise direction, jaws 40*a*, 40*b* and 40*c* pivot to grip drill pipe 1 in concave wrench recesses 20, 22 and 24. Jaws 40*a*, 40*b* and 40*c* each have a convex interior surface 44*a*, 44*b* and 44*c*, respectively, which are contoured to mate with one of concave wrench recesses 20, 22 and 24. Thus, the configuration of convex interior surfaces 44*a*, 44*b* and 44*c* are alterable to the extent that the configuration of concave wrench recesses 20, 22 and 24 are also variable as described herein. As automatic wrenching device 28 is moved from its non-gripping position in FIG. 3 to its gripping position in FIG. 4, the radial loads that are transmitted from drill pipe 1 being torqued or un-torqued through jaws 40*a*, 40*b* and 40*c*, through cam ring 38, pass into forward reaction piece 46 and rear reaction piece 48 before being transferred to work table 32 and main frame 30.

Figure 5:
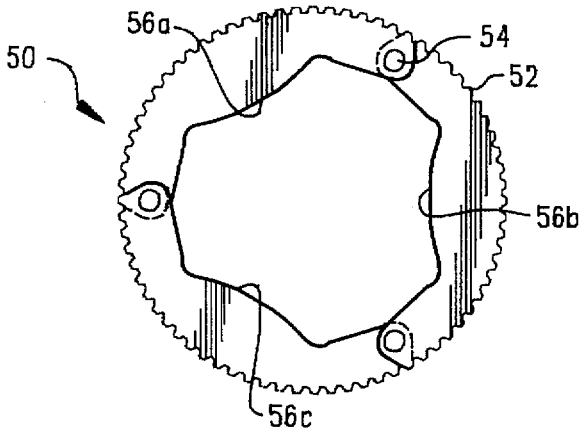
FIG. 5 is a top view a wrap-around wrench that can be employed to manually makeup and breakout the drill pipe of the present invention.

Referring now to FIG. 5, wrap-around wrench 50 is shown. U.S. Pat. No. 3,768,579 issued to Klein discloses a wrap-around wrench configuration generally known in the art, and is incorporated herein by reference. Wrap-around wrench 50 of FIG. 5 has been designed to function in conjunction with drill pipe 1 having concave wrench recesses 20, 22 and 24 of the present invention. More specifically, wrap-around wrench 50 includes spline teeth 52 which mate with teeth of a holding wrench (not shown). Wrap-around wrench 50 also includes hinge 54 which allows wrap-around wrench 50 to be opened in order to fit around drill pipe 1. When fitted around drill pipe 1, convex interior surfaces 56*a*, 56*b* and 56*c* are configured to mate with concave wrench recesses 20, 22 and 24. Again, convex interior surfaces 56*a*, 56*b* and 56*c* are variable to the extent that concave wrench recesses 20, 22 and 24 are altered such that convex interior surfaces 56*a*, 56*b* and 56*c* are matable with concave wrench recesses 20, 22 and 24.

Figure 6A:
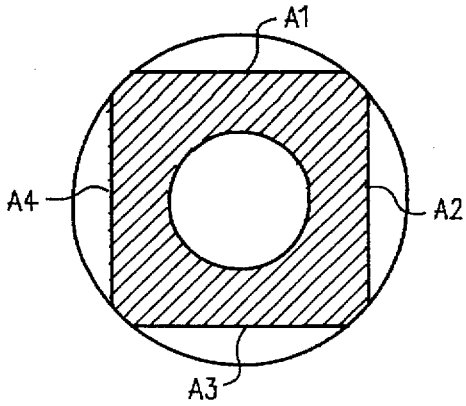
FIG. 6A PRIOR ART
FIG. 6A is a lateral cross-section of a prior art drill pipe configuration having four sides.
Figure 6B:
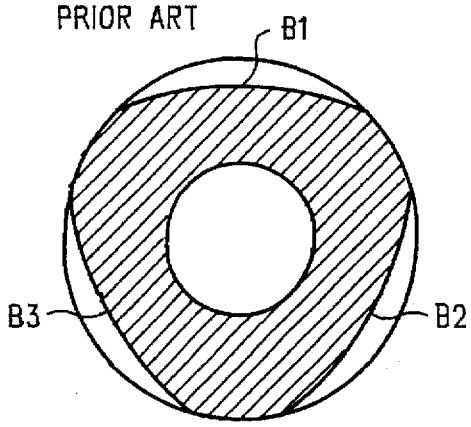
FIG. 6B PRIOR ART
FIG. 6B is a lateral cross-section of a prior art drill pipe configuration having three convex sides.
Figure 6C:
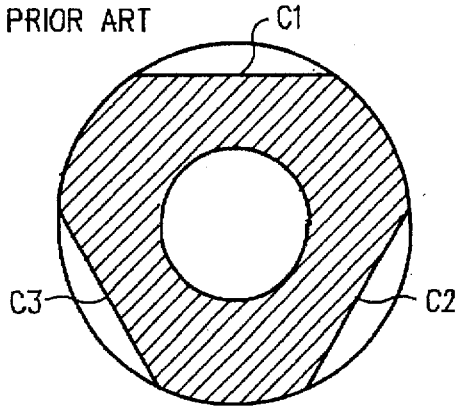
FIG. 6C PRIOR ART
FIG. 6C is a lateral cross-section of a prior art drill pipe configuration having three flat sides.
Figure 6D:
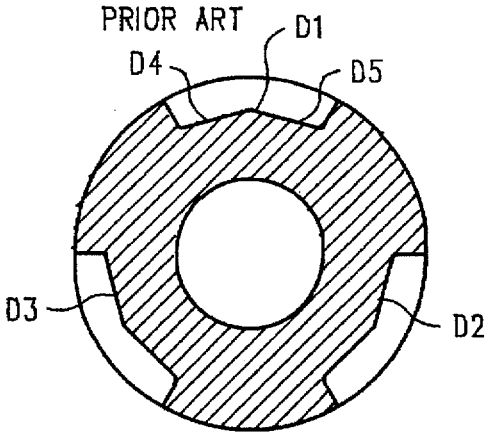
FIG. 6D PRIOR ART
FIG. 6D is a lateral cross-section of a prior art drill pipe configuration having three "bathtub" recesses, consisting of two adjoining planes forming a reflex angle (an angle of greater than 180 degrees) as measured from the exterior surfaces of the two adjoining planes.

Referring to FIGS. 6A through 6G, lateral cross-sections of prior art drill pipes having wrench flats (FIG. 6A through 6D) and drill pipes of the present invention having concave wrench recesses (FIGS. 6F through 6G) are shown. Referring to FIG. 6A, a prior art drill pipe having four sides A1, A2, A3 and A4 is shown. FIG. 6B shows a prior art drill pipe having three convex sides B1, B2 and B3. FIG. 6C shows a prior art drill pipe having three flat sides C1, C2 and C3. FIG. 6D shows a prior art drill pipe having a bathtub configuration with three recesses D1, D2 and D3 where each of the three recesses is comprised of two adjoining planes D4 and D5 whereby the adjoining planes form a reflex angle (an angle of more than 180 degrees) as measured between the exterior surfaces of D4 and D5.

Figure 6F:
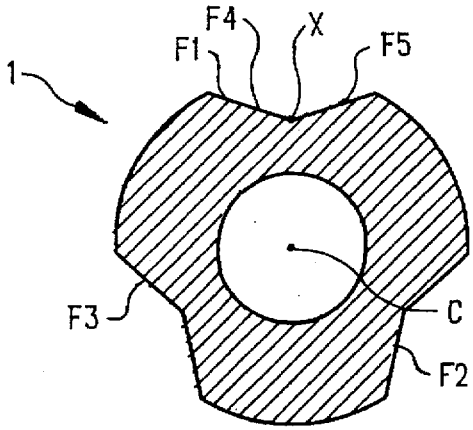
FIG. 6F is a lateral cross-section of a second embodiment of the drill pipe of the present invention, wherein the wrench recesses are each comprised of two adjoining planes.
Figure 6E:
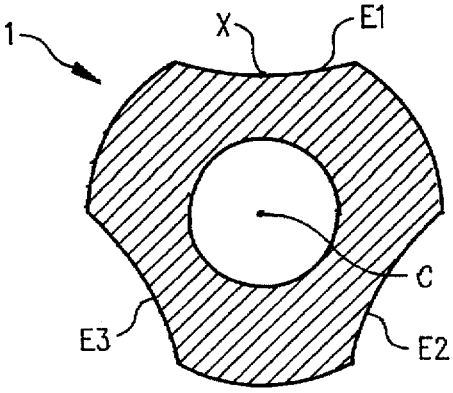
FIG. 6E is a first embodiment of the drill pipe of the present invention, wherein the wrench recesses are each comprised of an arcuate segment.

FIG. 6E shows drill pipe 1 having a substantially triangular cross-section with three concave wrench recesses E1, E2 and E3 therein. Concave wrench recesses E1, E2 and E3 are comprised of arcuate segments as defined in the discussion of FIG. 2 above. Axially extended center line X of concave wrench recesses E1, E2 and E3 is located a distance from central axis C of drill pipe 1 that is less than the distance from central axis C of all other axial lines on the surface of concave wrench recesses E1, E2 or E3.

FIG. 6F shows drill pipe 1 having a substantially triangular cross-section with three concave recesses F1, F2 and F3. Each concave recess F1, F2 and F3 is comprised of a first plane F4 adjoining a second plane F5. Adjoining planes F4 and F5 form an angle of less than 180 degrees as measured from the exterior surfaces of F4 and F5. Each of the three concave recesses F1, F2 and F3 has a center line X therein, which is located a distance from central axis C of drill pipe 1 that is less than the distance from central axis C of all other axial lines on the surface of recesses F1, F2 or F3.

Figure 6G:
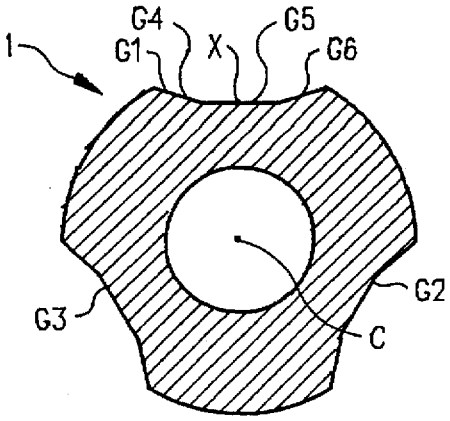
FIG. 6G is a third embodiment of the drill pipe of the present invention, wherein the wrench recesses are each comprised of three adjoining planes.

FIG. 6G shows drill pipe 1 having a substantially triangular cross-section with three concave wrench recesses G1, G2 and G3. Each of concave recesses G1, G2 and G3 are comprised of three adjoining planes G4, G5 and G6. Each of concave wrench recesses G1, G2 and G3 has a surface with an axially extending center line X that is located a distance from central axis C of drill pipe which is less than the distance from central axis C of all other axial lines on the surface of concave wrench recesses G1, G2 or G3.

Referring now to Table 1, load calculations for the drill pipes of FIGS. 6A through 6G are shown.

For each of FIGS. 6A through 6G, the moment of inertia, section modulus, polar moment of inertia, polar section modulus, shear area, support area, support bearing stress, minimum wrench load (radial) and minimum wrench load (tangential) are provided. It is important to note that, as shown in Table 1, the three-sided concave wrench recesses of the present invention shown in FIGS. 6E, 6F and 6G require markedly lower minimum wrench loads (radial) than do the prior art configurations of FIGS. 6A, 6B and 6C. FIG. 6D, the prior art bathtub configuration, has no wrench load (radial), but suffers from other shortcomings discussed above. The minimum wrench load (radial) differences between FIGS. 6A, 6B and 6C, and FIGS. 6E, 6F and 6G are noteworthy.

TABLE 1

| | FIG. 6A | FIG. 6B | FIG. 6C | FIG. 6D | FIG. 6E | FIG. 6F | FIG. 6G |
|---|---|---|---|---|---|---|---|
| Moment of Inertia (Mean), ins^4 | 752 | 996 | 1,008 | 939 | 1,018 | 1,022 | 1,022 |
| Section Modulus (Mean), ins^3 | 134 | 154 | 157 | 145 | 157 | 157 | 157 |
| Polar Moment of Inertia, ins.^4 | 1,504 | 1.993 | 2.016 | 1,879 | 2,036 | 2,044 | 2,043 |
| Polar Section Modulus, ins^3 | 232 | 307 | 310 | 289 | 313 | 315 | 314 |
| Shear Area, ins^2 | 74.6 | 89.6 | 89.9 | 84.8 | 89.8 | 89.5 | 89.9 |
| Support Area, ins^2 | 17.5 | 19.1 | 18.8 | n.a. | 19.0 | 19.2 | 18.9 |
| Support Bearing Stress, psi | 34,300 | 31,400 | 31,900 | n.a. | 31,700 | 31,200 | 31,800 |
| Minimum Wrench Load (Radial), lbs | 520,800 | 580,600 | 385,500 | zero | 297,000 | 305,900 | 302,000 |
| Minimum Wrench Load (Tangential), lbs | 332,500 | 221,700 | 221,700 | 221,700 | 221,700 | 221,700 | 221,700 |

Drill Pipe Outside Diameter: 330 mm (12⅞ ins)
Bore Diameter: 140 mm (5.51 ins)
Load Case:
Design Torque: 360,000 ft. lbs.
Maximum Dead Load: 600,000 lbs.

More specifically, the minimum wrench load (radial) for the prior art drill pipe of FIG. 6A is 520,800 pounds, for FIG. 6B is 580,600 pounds, for FIG. 6C is 385,500 pounds, while the minimum wrench load (radial) for the drill pipe invention of FIG. 6E is 297,000 pounds, for FIG. 6F is 305,900 pounds, and for FIG. 6G is 302,000 pounds. Note that the average minimum wrench load (radial) for the prior art drill pipe configurations of FIGS. 6A through 6C is 64.3% greater than the minimum wrench load (radial) for the drill pipe inventions of FIGS. 6E, 6F and 6G on average. The higher minimum wrench load (radial) of the prior art drill pipe configurations means that the wrench flats of these configurations are more likely than the wrench recesses of the drill pipe of the present invention to suffer damage during breakout or makeup, due to the greater load being applied to them.

Figure 7:
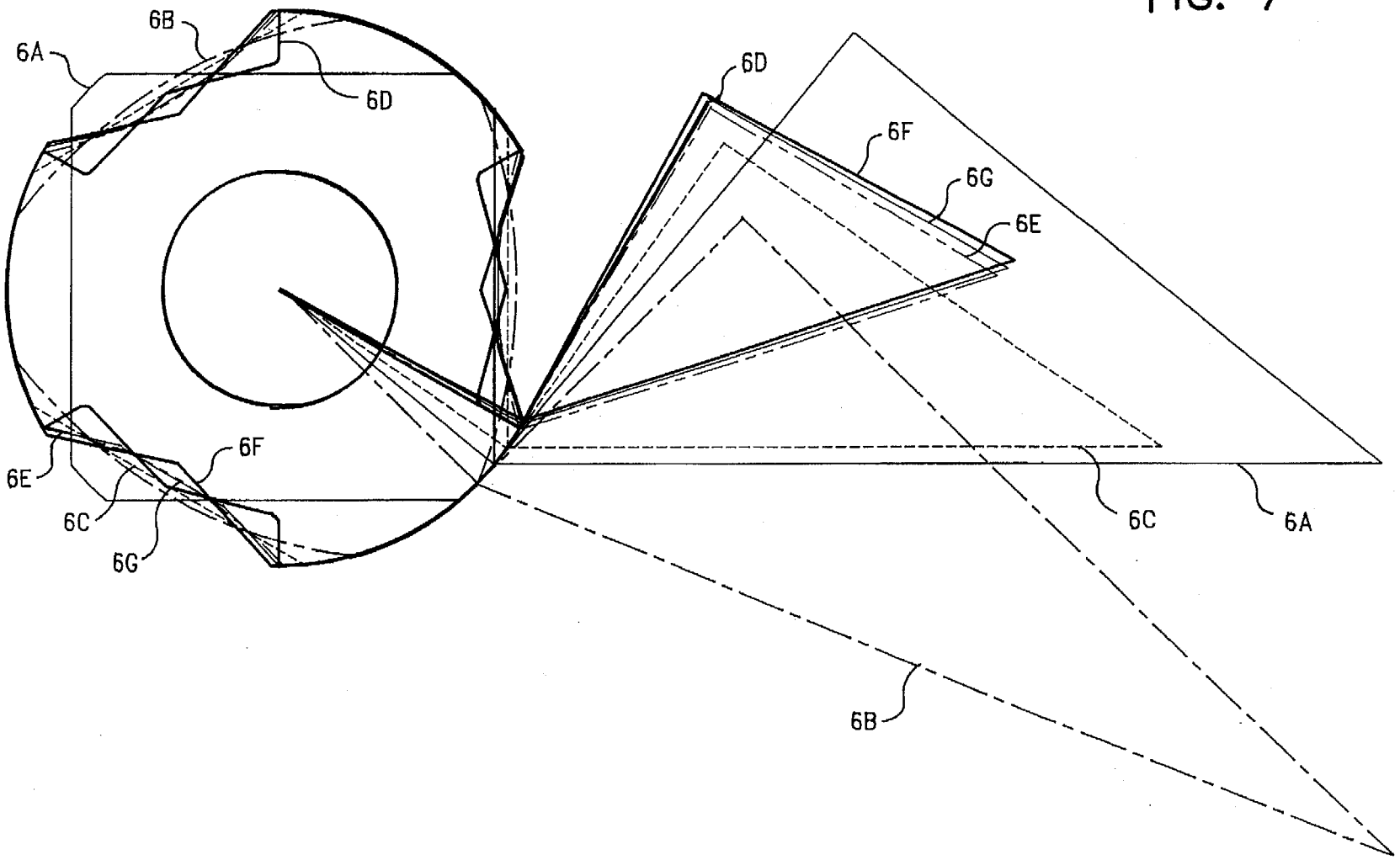
FIG. 7 is a composite figure having the lateral cross-sections of FIGS. 6A through 6G superimposed and having the associated radial and tangential force vectors for the drill pipes of FIGS. 6A through 6G.

Now referring to FIG. 7, the radial and tangential wrench load vectors for the drill pipes of FIGS. 6A through 6G are shown. FIG. 7 shows that the radial and tangential wrench loads for prior art drill pipe FIGS. 6A, 6B and 6C are greater than those for drill pipe FIGS. 6E, 6F and 6G of the present invention; the load vector for the prior art configuration of FIG. 6D (the bathtub configuration) not being relevant because of its zero radial load.

It is readily apparent to one skilled in the art that the above-described concave wrench recesses of the present invention, while described in regard to a single triangular portion on a single end of a drill pipe are readily applicable to two triangular portions on a single end of a drill pipe, these two portions being axially spaced. It is also readily apparent to one skilled in the art that a second end of the drill pipe can also be configured with three concave wrench recesses on a substantially triangular portion thereof; and that a second substantially triangular portion axially spaced from the first may further be present which also has three concave wrench recesses thereon.

While particular embodiments of the present invention have been described in some detail herein above, changes and modifications may be made in the illustrated embodiments without departing from the spirit of the invention.

I claim:

1. A drill pipe having a generally circular lateral cross-section and a central axis, and comprising:

a first end;

a second end, a portion of said second end being generally triangular in lateral cross-section and having three faces; and at least one concave wrench receiving recess in each of said three faces, each of said recesses having a surface with an axially extending center line thereon, said center line being located a predetermined distance from said central axis that is less than the distance from said central axis of the pipe to all other axial lines on said surface of said recess.

2. The drill pipe of claim 1 wherein said second end has a second portion being substantially triangular in lateral cross-section and having three faces, said second portion being axially spaced from said first portion, at least one concave wrench recess being present in each of said three faces of said second portion.

3. The drill pipe of claim 2 wherein each of said recesses has a surface with an axially extending center line thereon, said center line being located a predetermined distance from said central axis that is less than the distance from said central axis of the pipe to all other axial lines on said surface of said recess.

4. The drill pipe of claim 2 wherein said recesses on said portion of said second end are axially spaced from said recesses on said second portion of said second end.

5. The drill pipe of claim 1 wherein said second end has a portion being substantially triangular in lateral cross-section and has three faces with only one concave wrench recess located in each of said three faces.

6. The drill pipe of claim 5 wherein each of said recesses has a surface with an axially extending center line thereon, said center line being located a predetermined distance from said central axis that is less than the distance from said central axis of the pipe to all other axial lines on said surface of said recess.

7. The drill pipe of claim 5 wherein said second end has a second portion being substantially triangular in lateral cross-section and having three faces, said second portion being axially spaced from said first portion with only one concave wrench recess being present in each of said three faces of said second portion.

8. The drill pipe of claim 7 wherein each of said recesses has a surface with an axially extending center line thereon, said center line being located a predetermined distance from said central axis that is less than the distance from said central axis of the pipe to all other axial lines on said surface of said recess.

9. The drill pipe of claim 7 wherein said recesses on said portion of said second end are axially spaced from said recesses on said second portion of said first end.

10. The drill pipe of claim 1 wherein each of said recesses is comprised of two adjoining planes having exterior surfaces, the cross-section of said two adjoining planes forming an angle of less than 180 degrees as measured between said exterior surfaces of said two adjoining planes.

11. The drill pipe of claim 1 wherein each of said recesses is comprised of three adjoining planes.

12. The drill pipe of claim 1 wherein each of said recesses is comprised of an arcuate segment.

13. A drill pipe having a generally circular lateral cross-section and a central axis, and comprising:

a first end;

a second end, two axially spaced portions of said second end each being generally triangular in lateral cross-section and having three faces; and at least one concave wrench receiving recess in each of said three faces of each of said two axially spaced portions of said second end, each of said recesses having a surface with an axially extending center line thereon, said center line being located a predetermined distance from said central axis that is less than the distance from said central axis of the pipe to all other axial lines on said surface of said recess.

14. The drill pipe of claim 13 wherein said second end has a portion being substantially triangular in lateral cross-section and has three faces with only one concave wrench recess is located in each of said three faces.

15. The drill pipe of claim 14 wherein each of said recesses has a surface with an axially extending center line thereon, said center line being located a predetermined distance from said central axis that is less than the distance from said central axis of the pipe to all other axial lines on said surface of said recess.

16. The drill pipe of claim 14 wherein said second end has a second portion being substantially triangular in lateral cross-section and having three faces, said second portion being axially spaced from said first portion, and only one concave wrench recess being present in each of said three faces of said second portion.

17. The drill pipe of claim 16 wherein each of said recesses has a surface with an axially extending center line thereon, said center line being located a predetermined distance from said central axis that is less than the distance from said central axis of the pipe to all other axial lines on said surface of said recess.

18. The drill pipe of claim 16 wherein said recesses on said portion of said second end are axially spaced from said recesses on said second portion of said first end.

19. The drill pipe of claim 13 wherein each of said recesses is comprised of two adjoining planes having exterior surfaces, the cross-section of said two adjoining planes forming an angle of less than 180 degrees as measured between said exterior surfaces of said two adjoining planes.

20. The drill pipe of claim 13 wherein each of said recesses is comprised of three adjoining planes.

21. The drill pipe of claim 13 wherein each of said recesses is comprised of an arcuate segment.

22. A drill pipe having a generally circular lateral cross-section and a central axis, and comprising:

a first end;

a second end, a portion of said second end being generally triangular in lateral cross-section and having three faces; and at least one concave wrench receiving recess in each of said three faces, each of said recesses having two adjoining planes that intersect at an axially extending center line of said recess, each having an exterior surface, the cross-section of said two adjoining planes forming an angle of less than 180 degrees as measured between said exterior surfaces of said two adjoining planes.

23. The drill pipe of claim 22 wherein said second end has a second portion being substantially triangular in lateral cross-section and having three faces, said second portion being axially spaced from said first portion, at least one concave wrench recess being present in each of said three faces of said second portion.

24. The drill pipe of claim 23 wherein each of said recesses has two adjoining planes each having an exterior surface, the cross-section of said two adjoining planes forming an angle of less than 180 degrees as measured between said exterior surfaces of said two adjoining planes.

25. The drill pipe of claim 23 wherein said recesses on said portion of said second end are axially spaced from said recesses on said second portion of said second end.

26. The drill pipe of claim 22 wherein said second end has a portion being substantially triangular in lateral cross-section and has three faces, and at least one concave wrench recess is located in each of said three faces.

27. The drill pipe of claim 26 wherein each of said recesses has two adjoining planes each having an exterior surface, the cross-section of said two adjoining planes forming an angle of less than 180 degrees as measured between said exterior surfaces of said two adjoining planes.

28. The drill pipe of claim 26 wherein said second end has a second portion being substantially triangular in lateral cross-section and having three faces, said second portion being axially spaced from said first portion, at least one concave wrench recess being present in each of said three faces of said second portion.

29. The drill pipe of claim 28 wherein each of said recesses has two adjoining planes each having an exterior surface, the cross-section of said two adjoining planes forming an angle of less than 180 degrees as measured between said exterior surfaces of said two adjoining planes.

30. The drill pipe of claim 28 wherein said recesses on said portion of said second end are axially spaced from said recesses on said second portion of said first end.

31. The drill pipe of claim 22 wherein each of said recesses is comprised of three adjoining planes.

32. The drill pipe of claim 22 wherein each of said recesses is comprised of an arcuate segment.

33. A drill pipe having a generally circular lateral cross-section and a central axis, and comprising:

a first end;

a second end, two axially spaced portions of said second end each being generally triangular in lateral cross-section and having three faces; and at least one concave wrench receiving recess in each of said three faces of each of said two axially spaced portions of said second end, each of said recesses having two adjoining planes each having an exterior surface, the cross-section of said two adjoining planes that intersect at an axially extending center line of said recess, forming an angle of less than 180 degrees as measured between said exterior surfaces of said two adjoining planes.

34. The drill pipe of claim 33 wherein said second end has a portion being substantially triangular in lateral cross-section and has three faces, and at least one concave wrench recess is located in each of said three faces.

35. The drill pipe of claim 34 wherein each of said recesses has two adjoining planes each having an exterior surface, the cross-section of said two adjoining planes forming an angle of less than 180 degrees as measured between said exterior surfaces of said two adjoining planes.

36. The drill pipe of claim 34 wherein said second end has a second portion being substantially triangular in lateral cross-section and having three faces, said second portion being axially spaced from said first portion, at least one concave wrench recess being present in each of said three faces of said second portion.

37. The drill pipe of claim 36 wherein each of said recesses has two adjoining planes each having an exterior surface, the cross-section of said two adjoining planes forming an angle of less than 180 degrees as measured between said exterior surfaces of said two adjoining planes.

38. The drill pipe of claim 36 wherein said recesses on said portion of said second end are axially spaced from said recesses on said second portion of said first end.

39. The drill pipe of claim 33 wherein each of said recesses is comprised of three adjoining planes.

40. The drill pipe of claim 33 wherein each of said recesses is comprised of an arcuate segment.

* * * * *